US007492062B1

(12) United States Patent
Wristen et al.

(10) Patent No.: US 7,492,062 B1
(45) Date of Patent: Feb. 17, 2009

(54) MODULAR SWITCHGEAR CONTROL

(75) Inventors: Cecil C. Wristen, Hudson, OH (US); Jeffrey R. Rupp, Parma Heights, OH (US); Michael G. Walaszewski, Parma Heights, OH (US)

(73) Assignee: Vacuum Electric Switch Co., Akron, OH (US)

( * ) Notice: Subject to any disclaimer, the term of this patent is extended or adjusted under 35 U.S.C. 154(b) by 304 days.

(21) Appl. No.: 11/431,374

(22) Filed: May 10, 2006

(51) Int. Cl.
*H01H 19/64* (2006.01)

(52) U.S. Cl. ..... 307/113

(58) Field of Classification Search ..... 307/113
See application file for complete search history.

(56) References Cited

U.S. PATENT DOCUMENTS

| | | | | |
|---|---|---|---|---|
| 3,970,810 | A * | 7/1976 | Carroll et al. | 218/5 |
| 4,440,995 | A | 4/1984 | Lange et al. | 200/144 |
| 4,527,028 | A | 7/1985 | Luehring | 200/144 |
| 4,885,444 | A | 12/1989 | Lazar et al. | 200/401 |
| 4,996,646 | A | 2/1991 | Farrington | 364/483 |
| 6,331,687 | B1 | 12/2001 | Dunk et al. | 218/140 |
| 6,373,015 | B1 * | 4/2002 | Marchand et al. | 218/139 |
| 6,538,347 | B1 | 3/2003 | Baranowski et al. | 307/137 |
| 6,921,989 | B2 | 7/2005 | Baranowski et al. | 307/139 |

OTHER PUBLICATIONS

Photograph of a Joslyn Hi-Voltage Control, Model VBT, List No. 3045 B0261G2 Serial No. X95014, manufactured in 1995, showing internal cabinet features and inner surface of a door panel.
Photograph of a Joslyn Hi-Voltage Control, Model VBT, List No. 3045 B0261G2 Serial No. X95014, manufactured in 1995, showing inner surface of a door panel including a nameplate.
Photograph of a Joslyn Hi-Voltage Control, Model VBT, List No. 3045 B0261G2 Serial No. X95014, manufactured in 1995, showing internal cabinet details.

* cited by examiner

*Primary Examiner*—Robert L. Deberadinis
(74) *Attorney, Agent, or Firm*—Renner Kenner Greive Bobak Taylor & Weber

(57) ABSTRACT

A modular switchgear control to control the operation of one or more vacuum interrupter switches includes a cabinet that may contain one or more line powered or low energy control panels. Each low energy and line powered control panel allows multiple interrupter switches to be coupled in parallel so as to increase its current rating. Coupled to each line or low energy control panel is an input power panel, that receives single-phase power from a suitable power source. A controller panel and a timing panel may also be carried in the cabinet so as to coordinate the opening and closing of the interrupter switches in either an asynchronous or synchronous manner. A noise detection panel may also be provided to determine when the interrupter switches are beginning to fail.

18 Claims, 5 Drawing Sheets

MODULAR SWITCHGEAR CONTROL

TECHNICAL FIELD

The present invention relates generally to a switchgear control for controlling one or more vacuum interrupter switches. Particularly, the present invention is directed to a switchgear control that can be configured by a user with a desired combination of modular line powered panels, and modular low energy panels. Specifically, the present invention relates to a switchgear control that can be configured to control multiple vacuum interrupter switches arranged in a parallel configuration so as to achieve a desired current rating.

BACKGROUND ART

In certain instances it is necessary to switch or otherwise control the application of large amounts of electrical power that is delivered to a device, such as an electric furnace. Two types of switching equipment may be utilized to achieve this end—a circuit breaker or a load break switch. A circuit breaker is a switching device, which is designed to interrupt over currents on an infrequent basis. In fact, the circuit breaker is not designed to provide routine switching of power, and has poor reliability and reduced operating life if used in such a manner.

The load break switch, such as a vacuum interrupter switch, on the other hand is designed for frequent interruption, or switching of electrical currents, and is configured to be highly reliable over its operating life. However, load break switches generally have lower current ratings as compared to circuit breakers. As such, load break switches are normally configured in parallel to achieve a higher current rating. To achieve this increased current rating, a complex control system is required to coordinate the switching of the parallel load break switches.

Three-phase power is a type of power in which the total power is distributed evenly in each individual phase. Thus, the switching of three-phase power requires that each individual phase be switched separately by at least one switching element for each phase. However, when load currents exceed the current rating of the switch, multiple switches arranged in parallel may be utilized in each phase to increase the overall current rating of the switches. For example, a 30 MVA arc furnace with a 34 KV primary voltage requires 500 amperes of current for each of the three phases. Thus, to switch the 500 ampere current in each phase, three 500 ampere rated load switches (one switch per phase) would be needed to switch the current supplied to the furnace. In another example, a 60 MVA arc furnace with a 34 KV primary requires 1000 amperes of current for each of the three phases. As such, to accommodate the increased load current, two of the 500 ampere load switches would need to be placed in parallel in order to accommodate the 1000 ampere load current supplied to the furnace. In other words, two load switches per individual phase of the three-phase load, for a total of six load switches, are required to switch the supplied load current. In fact, a 90, 120, 150, or a 180 MVA furnace would require a total of nine, twelve, fifteen, or eighteen load switches respectively to switch the required load currents corresponding to 1500, 2000, 2500, or 3000 amperes.

Because load switches are generally used to switch three-phase power, the switches are arranged in multiples of three (one switch or groups of parallel switches per phase) to achieve the desired current rating for each phase. However, prior art switchgear controls used to coordinate the operation of multiple load switches are typically uniquely designed for each furnace, or individual application. As such, little commonality was provided between each of the switchgear controls. The unique design of the switchgear control, and the lack of commonality makes prior art switchgear controls highly complex, and difficult for technicians to analyze and troubleshoot. For example, when the switchgear control fails, the technician is often required to expend a substantial amount of time in gaining an understanding of the circuit layout of the control before an analysis can be performed.

Additionally, when multiple load switches are operated, as previously discussed, very large currents are required to control each of the load switches. For example, a single solenoid actuated load switch may require during its switching operation, 70 amperes of current at 120 volts. When multiple solenoid actuated load switches are utilized, the required control current increases greatly. However, in some remote areas, the large currents needed to operate the solenoid actuated load switches are not available, thus making prior art switches useless in such circumstances.

The manner in which electrical currents are switched may also have a impact on the longevity and the overall performance of the electrical device to which power is supplied. For example, when a transformer for a furnace is initially turned on, an electrical current passes through the windings, which may be many times greater in magnitude than the normal load currents. These large currents generate magnetic forces on the windings, which wears or degrades the winding's insulation. After the insulation on the windings fails, the transformer must be rewound, which is both costly in terms of lost production and repair costs.

Finally, when numerous parallel load switches are utilized for an application, it may become difficult to identify, and replace a particular load switch that has failed, or has nearly reached a failed state. Typically, the failed load switch is identified by removing all of the bus conductors to isolate and test each load switch individually. Unfortunately, such a process requires the expenditure of a tremendous amount of time and labor.

Therefore, there is a need for a modular switchgear control that can be configured in a modular manner with one or more line powered control panels, and low energy control panels that can be easily removed from a cabinet and replaced in a cabinet. Additionally, there is a need for a modular switchgear control that is scaleable, and can be configured with multiple line powered or low energy control panels so that one or more vacuum interrupter switches having reduced power ratings can be combined to achieve a higher overall current rating. Still yet there is a need for a need for a method of operating a low energy panel using capacitors. In addition, there is a need for an automated noise detection system that identifies when a vacuum switch has failed.

DISCLOSURE OF THE INVENTION

Therefore, one aspect of the present invention is to provide a modular switchgear control.

Another aspect of the present invention is to provide a modular switchgear control adapted to apply external power to three sets of vacuum interrupter switches, the control comprising a power input panel adapted to receive a single source of external power, at least one replaceable control panel connected to the power input panel and providing power to the at lest one vacuum interrupter panel, a controller panel connected to each of the replaceable control panels to coordinate operation of each vacuum interrupter switch.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
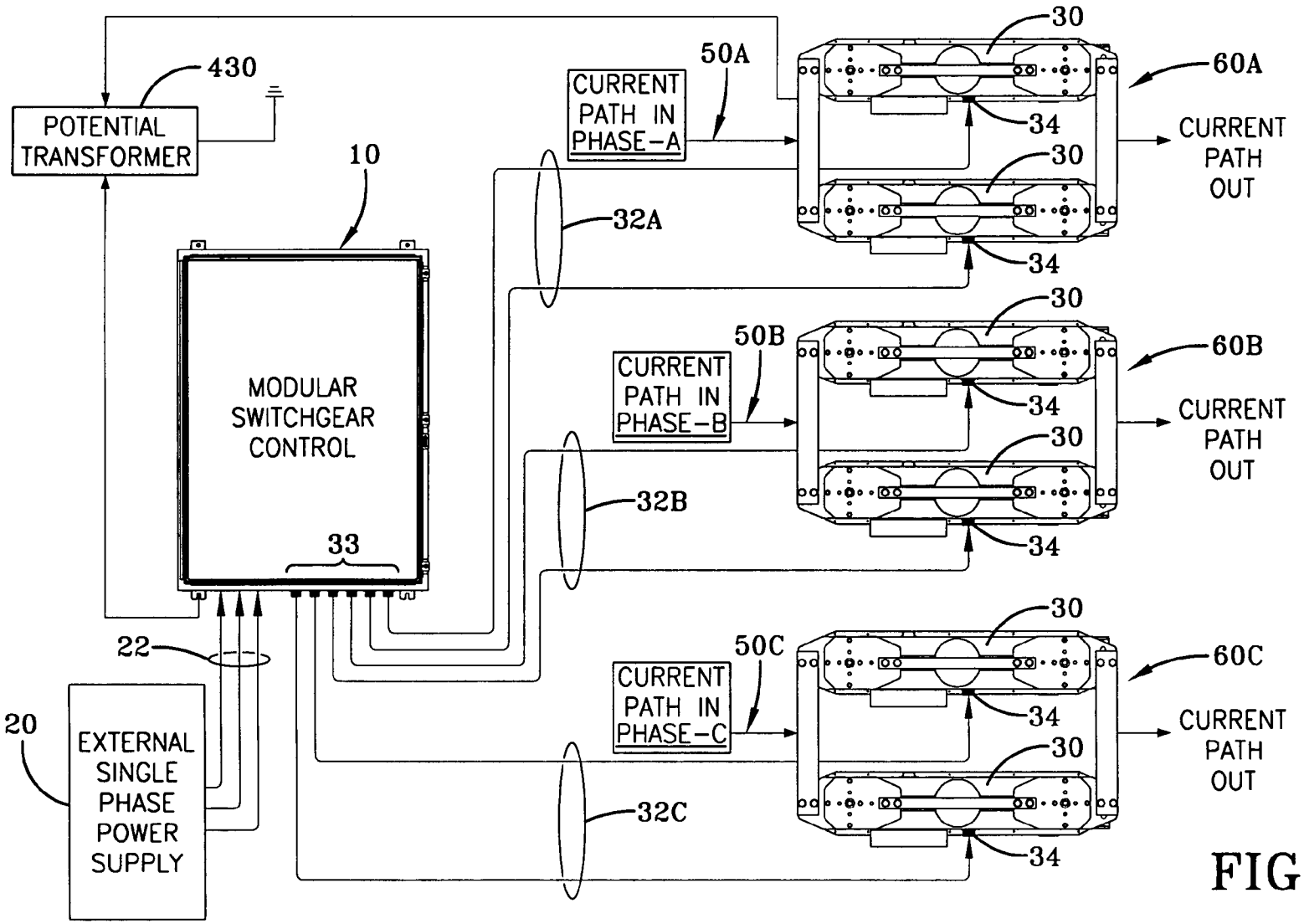
FIG. 1 is a schematic diagram of a modular switchgear control coupled to three sets of interrupter switches, according to the concepts present invention.

A modular switchgear control system according to the concepts of the present invention is generally designated by the numeral 10 as shown in FIG. 1 of the drawings. During operation, the switchgear control 10 is coupled at its input to an external power supply 20 via input power lines 22. The power supply 20 typically comprises a single-phase power supply, such as A.C. power supplied by a standard utility power line, or mains power line, for example. It should also be appreciated that the modular switchgear control 10 is adaptable for use with any commonly used power line input frequency.

Figure 2:
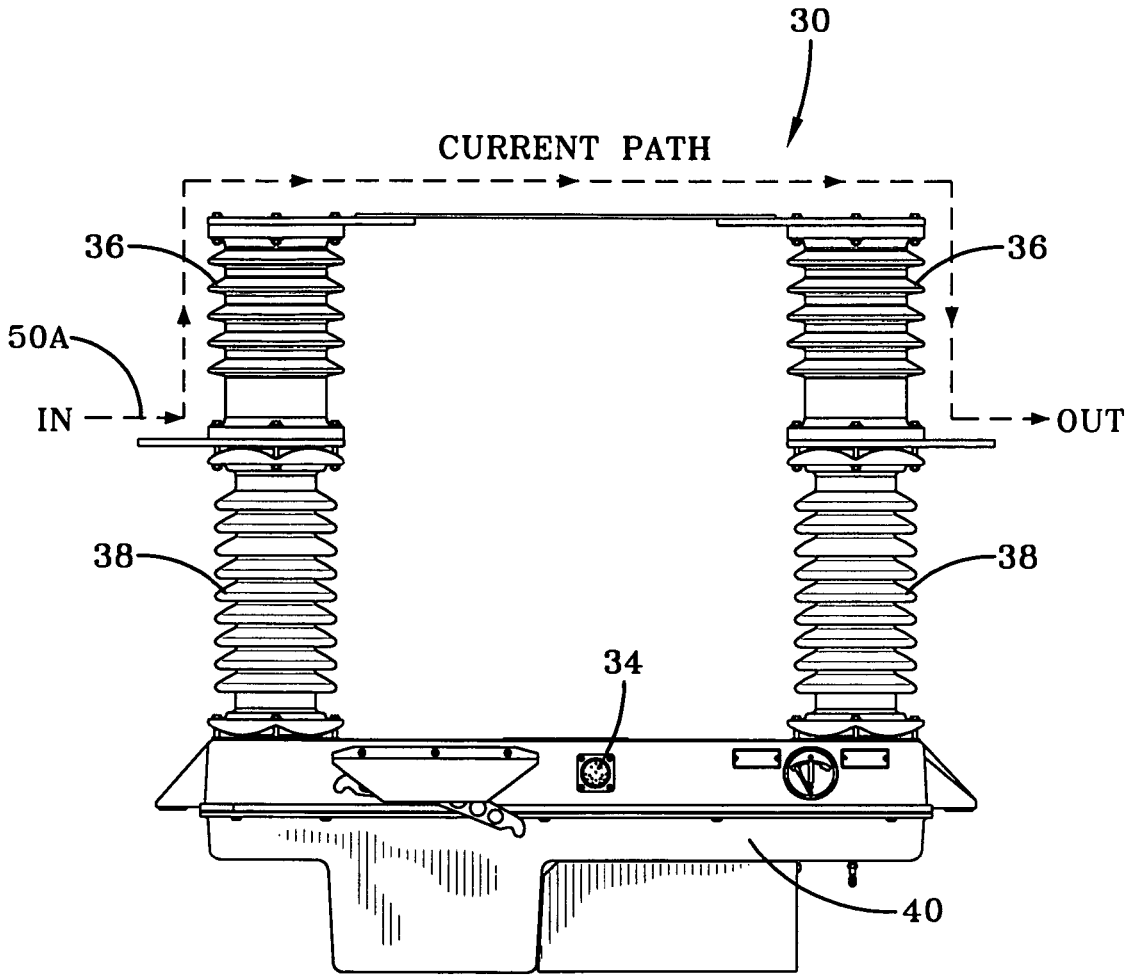
FIG. 2 is a schematic view of the vacuum interrupter switch used in association with the modular switchgear control, according to the concepts of the present invention.

During operation, the switchgear control 10 generates control signals, which are carried to multiple interrupter switches 30 via a plurality of external control lines 32A-C that are configured to be removably mated at one end with external control terminals 33, and at another end to a switch control receptacle 34. Each vacuum interrupter switch 30 generally comprises solenoid actuated vacuum interrupter switches, as shown in FIG. 2, and as further described in U.S. Pat. No. 4,527,028, entitled "Modular Vacuum Interrupter," which is incorporated herein by reference. Generally, each vacuum switch 30 comprises one or more interrupter modules 36, and insulators 38 that are attached to a solenoid actuating mechanism 40. It should be appreciated, that the vacuum switch 30 may comprise one or more interrupter modules 36 and corresponding insulators 38 arranged in series or parallel to achieve the desired current and voltage ratings. Thus, while the interrupter switch 30 shown in FIGS. 1 and 2 Fig. are comprised of two interrupter modules 36 arranged in series, it is not required, as any number of modules 36 arranged in series or parallel may be utilized to comprise the switches 30.

The interrupter switches 30 are each used to switch the load current supplied by each phase 50A, 50B, and 50C of a three-phase load power source (not shown). Specifically, each of the three phases 50A-C of the load power source are switched by three sets 60A-C of vacuum interrupter switches 30, whereby each set 60A-C comprises one or more interrupter switches 30 coupled in parallel. In other words, each set 60A-C of interrupter switches 30 are utilized to switch an individual phase of the three-phase load power source. For example, in FIG. 1, the vacuum switches 30 are arranged in sets 60A-C having two interrupter switches 30 coupled in parallel. In one aspect, the parallel coupling of interrupter switches 30 may be achieved by utilizing various buss bars, for example. As such, by configuring each of the three sets 60A-C with the desired number of parallely arranged vacuum switches 30, the electrical current rating of each set 60A-C is increased, thus allowing the control 10 to accommodate load currents of different magnitudes. Furthermore, the switchgear control 10 may manage the use of lower cost vacuum interrupter switches 30 that have low individual current ratings, such that when combined in parallel, allows the resultant set of interrupter switches 30 to achieve an increased overall current rating. That is, the switchgear control 10 allows multiple vacuum interrupter switches 30 that have reduced electrical handling specifications to be combined as desired, so that the aggregate power rating for the set 60A-B of interrupter switches 30 meets or exceeds the electrical capacity of the load current being switched.

In one example, an application may require switching of a 34 KV, 1000 amp three-phase load, while the user has available only vacuum interrupter switch 30 with a voltage rating of 34 KV and a current rating of 500 amps. Thus, in order to accommodate the 1000 amp load current to be switched, two of the 500 amp rated interrupter switches are arranged in parallel within each set 60A-C, with each set 60A-C respectively used to switch one phase 50A-C of the three-phase load. As such, the newly configured sets 60A-C of vacuum interrupter switches each comprising two individual interrupter switches 30 achieves a total voltage rating of 34 KV with a current rating of 1000 amps. Thus, by combining two vacuum interrupter switches 30 in parallel, the user is able to switch the 34 KV, 1000 ampere load current. While the previous discussion relates to the use of two vacuum interrupter switches 30 per set 60A-C, such discussion should not be construed as limiting, as each set 60A-C of parallel interrupter switches 30 may comprise one or more vacuum interrupter switches 30 as desired.

Figure 3:
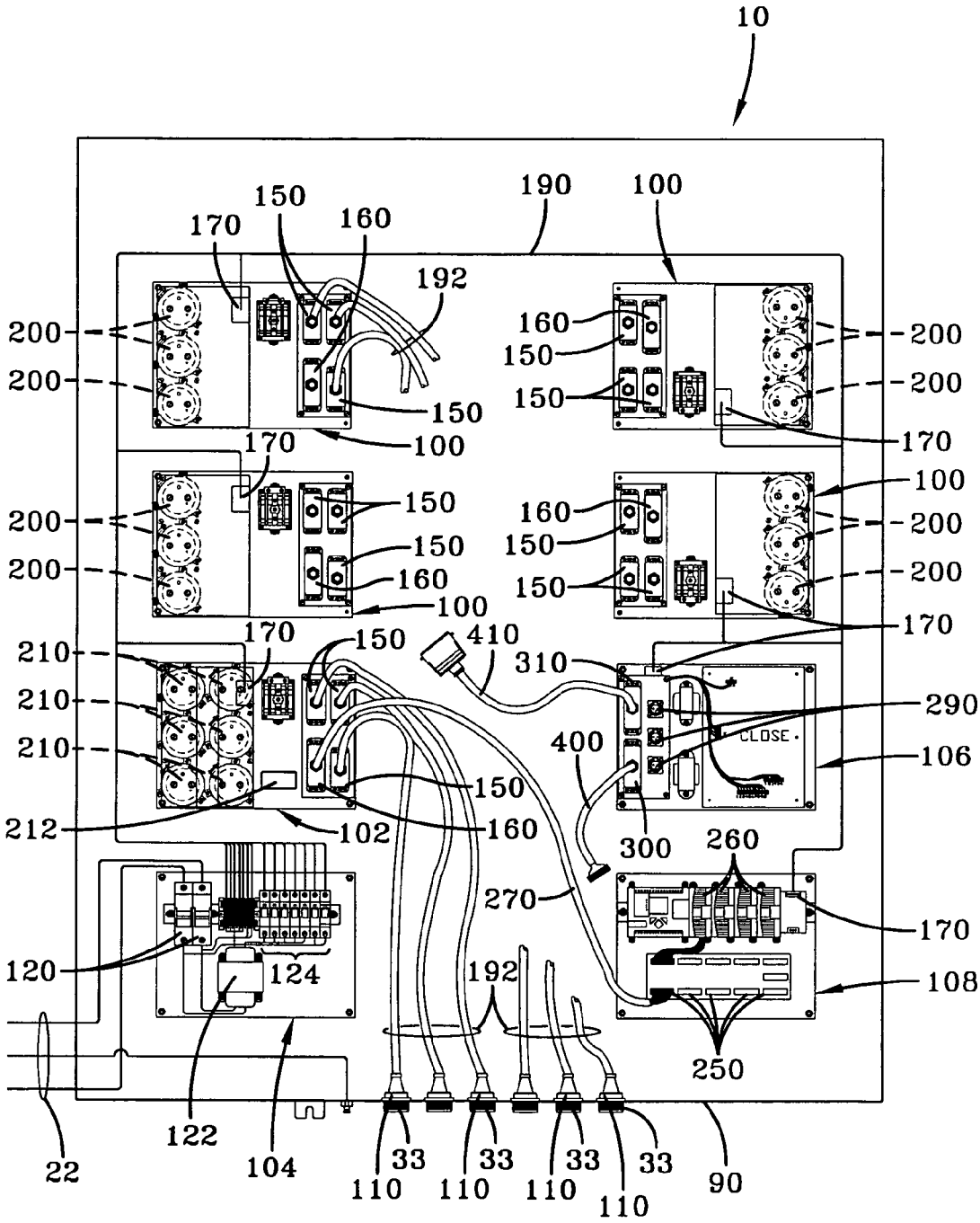
FIG. 3 is a front schematic view of the switchgear control.

The switchgear control 10, as shown in FIG. 3, comprises a cabinet 90 that allows various control panels to be easily removed and installed. The cabinet 90 is typically a metal enclosure with a hinged door that may be locked. The cabinet 90 provides the necessary openings to allow connection to related components and appropriate structure for supporting internal components to be described. In any event, the switchgear control 10 is configured to control a desired number of vacuum interrupter switches 30. Within the cabinet 90 may reside a line powered control panel 100, a low energy control panel 102, a power input panel 104, a timing panel 106, and a controller panel 108. The panels 100-108 each comprise circuit boards containing various electrical components that enable various functions to be described. In one aspect of the invention, the panels 100-108 may be configured to be installed within, or removed from the cabinet 90 without the use of any tool, or minimal tools. Finally, the cabinet 90 contains a plurality of internal control terminals 110 that are associated with corresponding external control terminals 33. Additionally, the ability of the panels 100-108 to be readily removed and installed allows the switchgear control 10 to be easily repaired with a corresponding replacement panel should any one of the panels fail. Further, it is also contemplated that the physical dimensions, specifically the size and weight, of each of the panels 100-108 are suitable for transport via standard shipping means, or the like, thus allowing a user of the switchgear control 10 to easily acquire the panels 100-108 in an expedited manner if needed.

The power input panel 104 comprises one or more fuses 120 that are coupled to the power lines 22 of the control power supply 20. An isolation transformer 122, is coupled between the fuse 120, and one or more circuit breakers 124. Specifically, the transformer 122 charges various capacitors provided by each of the line powered control panels 100. The circuit breakers 124 are individually associated with each of the panels 100-108, allowing power supplied thereto to be manually turned on or off. In addition, the circuit breakers 124 provide input protection from any electrical over currents that may appear on the power lines 22 coupled to the input power panel 104, and allows a user to turn the power to the switchgear control 10 on or off, when the panels 100-108 need to be replaced.

The line powered control panels 100 and the low energy control panels 102 are the primary components of the switchgear control 10, and are responsible for scaling the number of interrupter switches 30 used in each set 60A-C. Thus, for each line powered or low energy panel 100,102 installed, the control 10 is able to control an additional three interrupter switches 30 (i.e. one additional switch per set 60A-C). This ability to scale the number of interrupter switches 30 allows the switchgear control 10 to switch load currents of varying electrical current magnitudes. The line powered control panels 100 and the low energy control panels 102 each have three output receptacles 150 and a panel control receptacle 160 which are structurally identical to each other. And modular panels 100, 102, 106, and 108 each contain a power receptacle 170, which are structurally equivalent to each other. In addition, the control 10 provides a power distribution cable 190 that is coupled at one end to the circuit breakers 124, and terminated at the other end with suitable connectors configured to be removably mated with each power receptacle 170.

A group of three output cables 192 are utilized with each panel 100,102 that is installed in the switchgear control 10. Each of the cables 192 are terminated with suitable connectors, so as to allow the cables 192 to be removably mated between the three output receptacles 150 desired panel 100, 102, and a group of three internal control terminals 110. Once connected, the panels 100,102 are able to send control signals to the interrupter switches 30 so as to actuate the solenoid 40 in order to turn each interrupter switches 30 on and off.

The line powered control panel 100 includes line capacitors 200 that are charged via the transformer 122 of the power input panel 104, and provide power to each of the three vacuum interrupter switches 30 used in each set 60A-C of the interrupter switches 30 to which the line powered control panel 100 is coupled. This allows the line powered panel 100 to actuate the solenoid 40 of the corresponding interrupter switches 30, thus preventing an overload condition at one of the individual vacuum interrupter switches 30 in case of a failure of the power supply 20. For example, if power is lost for any reason, the line capacitors 200 provide a suitable amount of energy to allow the vacuum interrupter switches 30 associated with the corresponding vacuum interrupter switch 30 to open so as to prevent overload damage from occurring. The low energy panel 102 includes a plurality of storage capacitors 210 that are capable of high-capacity power storage. Such storage capacitors 210 are charged via a charging transformer 212 provided by the low energy panel 102. And the storage capacitors 210 allow the low energy control panel 102 to operate the interrupter switches 30 coupled thereto, when the switchgear control 10 is utilized in an environment where the control power source 20 cannot supply large control currents to actuate the solenoid 40 of each of the vacuum interrupter switches 30. In such a situation, the power to actuate the solenoid 40 of the vacuum interrupter switches 30 is provided from the storage capacitors 210. Additionally, the storage capacitors 210 also assist in the operation of the switches 30 when the power source 20 has failed, as previously discussed.

The controller panel 108 provides the logic control that coordinates the operation of each panel 100,102 utilized in conjunction with the switchgear control 10. Specifically, the controller panel 108 comprises a plurality of controller receptacles 250 which are associated with an individual IO ports 260. The controller panel 108 sends control signals to each of the line powered and low energy control panels 100,102 via a controller cable 270. Specifically, the controller cable 270 is terminated at each end with suitable connectors that allow it to be removably mated at one end to the controller receptacle 250, and at another end to the panel control receptacle 160 of each line powered or low energy panel 100,102 being used. Briefly, the controller panel 108 may comprise a programmable logic control (PLC) that may be programmed to accommodate the use of any number of interrupter switches 30. It should also be appreciated that the control functions provided by the controller panel 108 may be embodied in software, hardware, or a combination of both. As previously discussed, the use of interrupter switches allows the switchgear control 10 to be easily scaled to switch load currents 50A-C of various capacities. Thus, the controller panel 108 may be programmed and configured with additional input/output (IO) ports 260, and controller receptacles 250 to accommodate additional interrupter switches 30. Additionally, the controller panel 108 may provide a diagnostic function in which the malfunction of a particular line powered control panel 100, low energy panel 102, or switch 30 can be readily isolated. In one aspect, the user of the switchgear control 10 may interface a personal computer, handheld computing device, or computer network with the controller panel 108 to program the controller panel 108, or diagnose any malfunction of an individual line powered or low energy control panel 100,102.

Continuing with FIG. 3, the timing panel 106 comprises a synchronous timer that may be optionally utilized with any low energy panel 102 installed in the switchgear control 10. The timing panel 106 is configured to control the opening and closing of the contacts of the vacuum interrupter switches 30 synchronously, at the zero crossing or voltage peak of the A.C. sinusoidal voltage from the reference transformer 430. Specifically, the process of synchronous switching, or interruption varies depending on whether a transformer or capacitor load is being utilized with the switches 30. In a capacitor load, the switches 30 are closed at the A.C. voltage zero in each of the three phases 50A-C in order to eliminate the transient that occurs when the capacitors of the load are energized. Synchronous interruption of a capacitor load, on the other hand, is generally not important. In the case of a transformer load, such as an arc furnace transformer, the direction of the residual flux in the transformer core is important, so that a sudden flux reversal when the transformer is energized can be prevented. When the transformer is re-energized, the voltage is switched so that the polarity corresponds to the residual flux direction as required by the applied voltage. In addition, the voltage is switched at the voltage peak in each phase to eliminate the current transient that is generated. Thus, by opening and closing the interrupter switches 32 synchronously, transients are minimized, thus extending the useful life of the transformers supplying power to an arc furnace or other equipment coupled thereto. Three calibration receptacles 290 are provided by the timing panel 106, which are configured to be coupled, via suitable cables, to one switch 30 in each of the three sets 60A-C of switches 30. When coupled, the timing panel 106 is configured to learn the switching speed (i.e. the speed at which an interrupter switch opens and closes) of one switch 30 in each group 60A-C. The timing panel 106 also includes an input timing control receptacle 300, and an output timing control receptacle 310.

In order to invoke synchronous operation of the switchgear control 10, the timing panel 106 is coupled between the controller panel 108, and one of the low energy panels 102, using an input timing cable 400 and an output timing cable 410. The input timing cable 400 is terminated with suitable connectors to allow the input timing cable to be coupled between the output timing receptacle 310 of the timing panel 106, and the controller receptacle 250 of the controller panel 108. While the output timing cable 410 is terminated with suitable connectors to allow the output timing cable 410 to be removably mated between the output timing receptacle 310 and the panel control receptacle 160 of the low energy panel 102. Once the cables 400 and 410 are installed, the control of the vacuum interrupter switches 30 are carried out in a synchronous manner. As such, the timing panel 106 establishes the switching time of the individual vacuum interrupter switches 30 relative to the zero crossing or voltage peak of the supply voltage associated with a reference signal from one of the phases 50A, 50B, and 50C via a potential transformer 430 that is coupled to the timing panel 106 as shown in FIG. 1. It should be appreciated that if multiple low energy panels 102 are utilized, that only one of them needs to be coupled to the timing panel 106 to achieve synchronous operation, regardless of whether additional low energy panels 102 or line powered panels 100 are also utilized to control one or more of the interrupter panels 30.

To enable asynchronous operation of the switchgear control 10, the timing panel 106 is not utilized, and all the line powered control panels 100, and all low energy control panels 102 are coupled via their panel control receptacles 160 to the control receptacles 250 of the controller panel 108 via the controller cable 270. When the control 10 is being operated asynchronously, the operation of the vacuum interrupter switches 30 results in each interrupter switch 30 being turned on and off asynchronously (i.e. randomly) with respect to the zero crossing or voltage zero of the voltage and current of each of the phases 50A-C.

Thus, in summary, when the user desires to install additional line powered or low energy panels 100,102 he or she couples each power input receptacle 170 of the desired line powered or low energy panel 100,102 to the power distribution cable 190. Next, the three output receptacles 150 of the panel 100,102 are coupled to the internal control terminals 110, via output cables 192. And the panel control receptacle 160 is coupled to the controller receptacle 250 of the controller panel 108 for asynchronous operation. Finally to complete the installation, the switches 30 are coupled to the external control terminals 33 corresponding to each installed line powered or low energy panel 100,102. This process is repeated for each additional line powered panel 100 or low energy panel 102 added to the cabinet 90.

Figure 4:
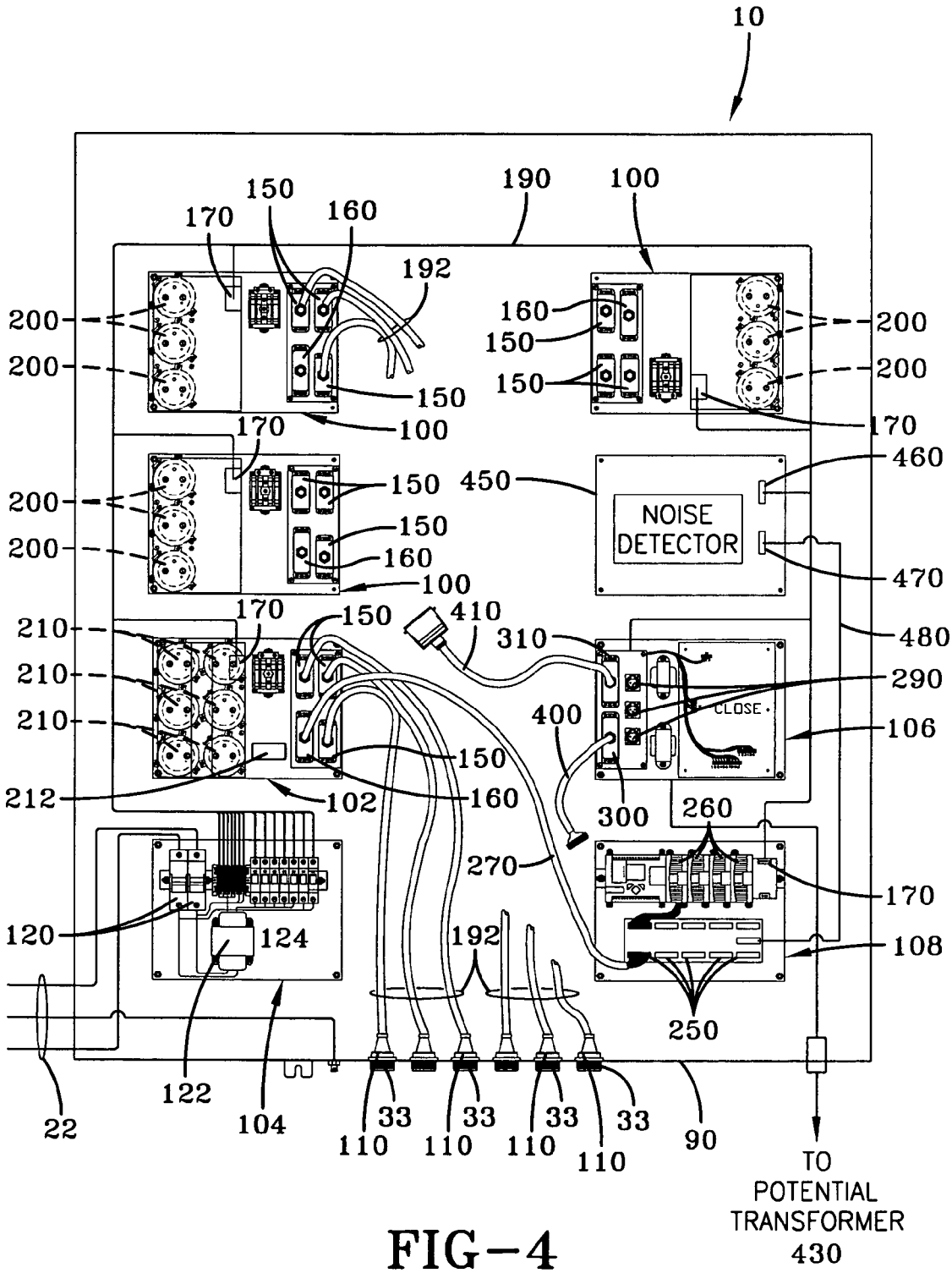
FIG. 4 is a front schematic of the modular switchgear control, showing a noise detection panel, according to the concepts of the present invention.

In another aspect of the switchgear control 10, a noise detection panel 450, as shown in FIG. 4, that employs a noise test mode, may be installed in the cabinet 90. Specifically, the noise detection panel 450 comprises an RF receiver that is configured to detect various radio frequency (RF) signals. The detection panel 450 is coupled to the power distribution cable 190 by suitable connectors that are configured to be removably mated with a detector power receptacle 460. In addition, the controller panel 108 is coupled to a detection control receptacle 470 by a detection cable 480 that is terminated with suitable connectors that are configured to be removably mated with the control receptacle, and controller panel 108. It is also contemplated that the circuitry and logic comprising the noise detection panel 450 may be integrated into the hardware or software logic of the controller panel 108, thereby eliminating the need for a dedicated noise detection panel.

Briefly, as the vacuum interrupter switches 30 age the sealed vacuum housing (not shown) provided by the interrupter module 36 of the interrupter switches 30 begins to leak, thus increasing the pressure inside the vacuum housing. This pressure increase provides an environment in which an electrical discharge, in the form of RF noise may occur when the contacts of the interrupter switch 30 are opened. Thus, by monitoring the noise, or RF signals, generated by each vacuum interrupter switch 30 utilized with the switchgear control 10, the noise detection panel 450 is able to detect when an individual vacuum interrupter switch 30 is beginning to reach its failure point.

Figure 5:
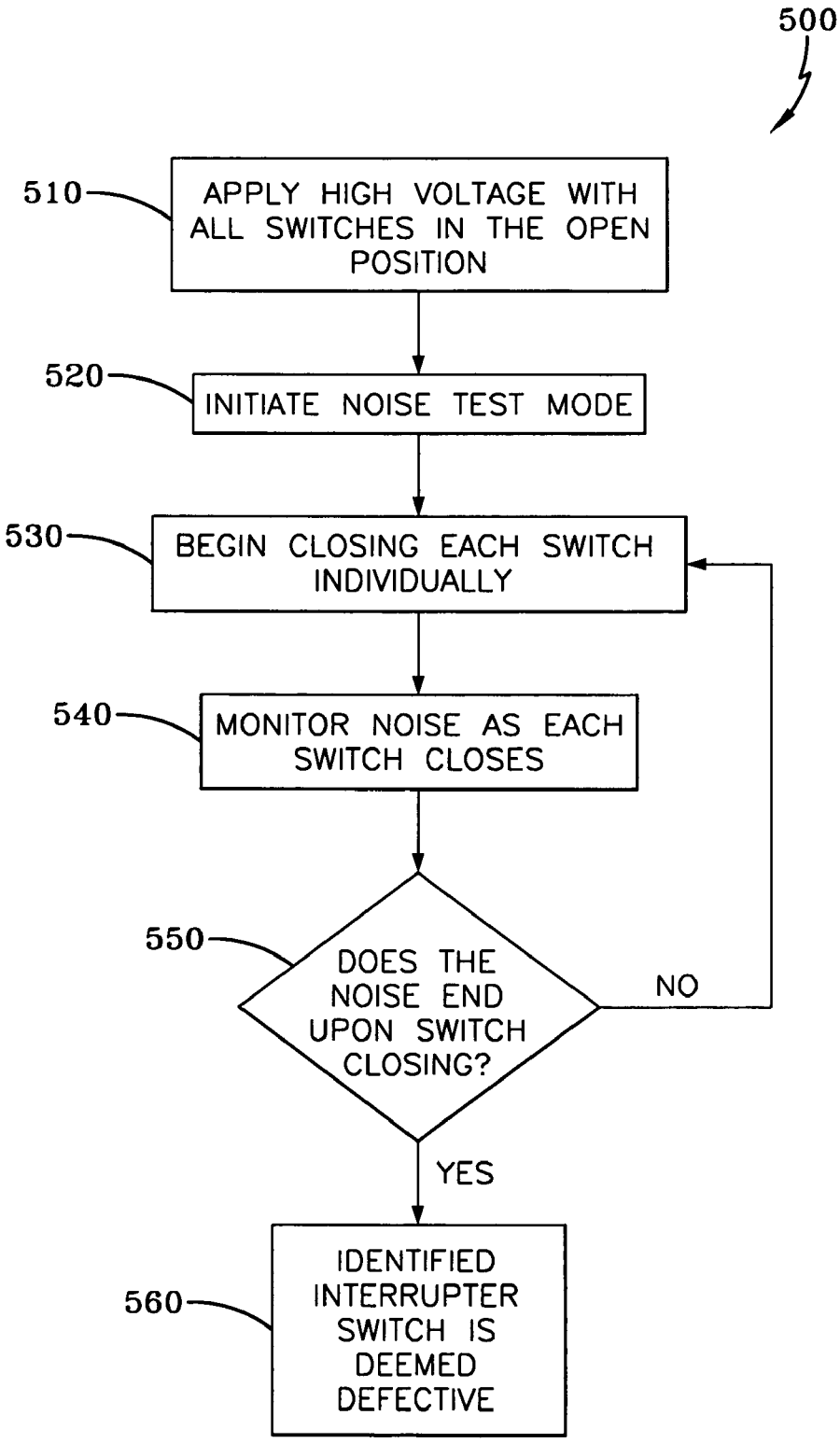
FIG. 5 is a flow chart showing the operational steps taken by a noise detection panel of the switchgear control to detect noise generated by one or more vacuum interrupter switches.

The operational steps for detecting noise generated by one or more of the interrupter switches 30 controlled by a particular panel 100,102 are generally indicated by the numeral 500, as shown in FIG. 5. At step 510 the process applies high-voltage to each of the interrupter switches 30, while each of the individual interrupter switches 30 are open. The process 500 continues to step 520, where the noise test mode is initiated. Such initiation may be achieved by several methods, such as a noise test button. Next, each individual interrupter switch 30 is sequentially closed, as indicated at step 530. At step 540 and 550, the noise detection panel proceeds to monitor the closing of each interrupter switch 30, to determine if the generated noise ends. If the noise ends, then the noise detection panel identifies that interrupter switch 30 as being defective and in need of replacement, as indicated at step 560. However, if the noise does not end, then the process 500 returns to step 530, so as to evaluate the next interrupter switch 30.

It will, therefore, be appreciated that one advantage of one or more embodiments of the present invention is that a modular switchgear control is able to be easily configured with a combination of line powered control panels and low energy control panels to accommodate various current switching requirements of a particular application. Still another advantage of the present invention is that the modular switchgear control is configured to control multiple vacuum interrupter switches arranged in parallel so as to achieve a desired current rating to meet or exceed the switching requirements of a particular application. Yet another advantage of the present invention is that the modular switchgear control includes a timing panel that allows the low energy panels to control the vacuum interrupter panels synchronously with reference to the voltage generated by a potential transformer. Still another advantage of the present invention is that the noise detection panel provides a simple way to proactively determine if an interrupter switch is close to failing or has failed. If such an event is detected, the switch can be replaced during the next convenient down time, thus avoiding wasted time disassembling the buss work of the switch and testing each switch.

Although the present invention has been described in considerable detail with reference to certain embodiments, other embodiments are possible. Therefore, the spirit and scope of the appended claims should not be limited to the description of the embodiments contained herein.

What is claimed is:

1. A modular switchgear control adapted to control at least one set of three vacuum interrupter switches, the control comprising:

a power input panel adapted to receive a single source of external power;

at least one replaceable control panel connected to said power input panel and providing power to the at least one set of vacuum interrupter switches; and a controller panel connected to each of said replaceable control panels to coordinate operation of each set of vacuum interrupter switches, wherein said at least one replaceable control panel is selected from a group consisting of a line powered control panel and a low energy control panel, and wherein said controller panel operates said at least one replaceable control panel asynchronously with respect to a reference voltage.

2. The control according to claim 1, further comprising:

a cabinet to carry said panels, wherein operation of said at least one replaceable control panel is modifiable by said controller panel.

3. The control according to claim 2, wherein any combination of line powered and low energy control panels are carried by said cabinet.

4. The control of claim 1, wherein said controller panel comprises a programmable logic control.

5. A modular switchgear control adapted to control at least one set of three vacuum interrupter switches, the control comprising:

a power input panel adapted to receive a single source of external power;

at least one replaceable control panel connected to said power input panel and providing power to the at least one set of vacuum interrupter switches;

a controller panel connected to each of said replaceable control panels to coordinate operation of each set of vacuum interrupter switches, wherein said at least one replaceable control panel is selected from a group consisting of a line powered control panel and a low energy control panel; and a timing panel connected between said controller panel and said low energy control panel so that said low energy control panel operates synchronously with respect to a reference voltage.

6. The control of claim 5, wherein said controller panel comprises a programmable logic control.

7. The control according to claim 5, further comprising:

a cabinet to carry said panels, wherein operation of said at least one replaceable control panel is modifiable by said controller panel.

8. The control according to claim 7, wherein any combination of line powered and low energy control panels are carried by said cabinet.

9. A modular switchgear control adapted to control at least one set of three vacuum interrupter switches, the control comprising:

a power input panel adapted to receive a single source of external power;

at least one replaceable control panel connected to said power input panel and providing power to the at least one set of vacuum interrupter switches; and a controller panel connected to each of said replaceable control panels to coordinate operation of each set of vacuum interrupter switches, said controller panel comprising a programmable logic control, wherein said programmable logic control tests each said interrupter switch or said control panel to determine if replacement is required.

10. The control of claim 9, wherein said controller panel comprises a programmable logic control.

11. The control according to claim 9, wherein said at least one replaceable control panel is selected from a group consisting of a line powered control panel and a low energy control panel.

12. The control according to claim 11, further comprising:

a cabinet to carry said panels, wherein operation of said at least one replaceable control panel is modifiable by said controller panel.

13. The control according to claim 12, wherein any combination of line powered and low energy control panels are carried by said cabinet.

14. A modular switchgear control adapted to control at least one set of three vacuum interrupter switches, the control comprising:

a power input panel adapted to receive a single source of external power;

at least one replaceable control panel connected to said power input panel and providing power to the at least one set of vacuum interrupter switches;

a controller panel connected to each of said replaceable control panels to coordinate operation of each set of vacuum interrupter switches; and a noise detection panel coupled to said replaceable controller panels so as to detect the presence and absence of noise generated by the at least one vacuum interrupter switch, wherein detected noise is an indication of failure.

15. The control of claim 14, wherein said controller panel comprises a programmable logic control.

16. The control according to claim 14, wherein said at least one replaceable control panel is selected from a group consisting of a line powered control panel and a low energy control panel.

17. The control according to claim 16, further comprising:

a cabinet to carry said panels, wherein operation of said at least one replaceable control panel is modifiable by said controller panel.

18. The control according to claim 17, wherein any combination of line powered and low energy control panels are carried by said cabinet.

* * * * *